US005839588A

United States Patent [19]

Hawkinson

[11] Patent Number: 5,839,588

[45] Date of Patent: Nov. 24, 1998

[54] TRACK SYSTEM FOR FEEDING OF PRODUCT AT POINTS OF SALE

[76] Inventor: Terry B. Hawkinson, 105 Vixen Ct., Austin, Tex. 78734

[21] Appl. No.: 773,067

[22] Filed: Dec. 26, 1996

[51] Int. Cl.[6] ..... A47F 5/00

[52] U.S. Cl. ..... 211/59.3; 211/184; 312/71

[58] Field of Search ..... 211/59.3, 59.2, 211/184; 312/71, 45

[56] References Cited

U.S. PATENT DOCUMENTS

| | | | |
|---|---|---|---|
| 4,724,968 | 2/1988 | Wombacher | 211/59.3 |
| 4,762,236 | 8/1988 | Jackle et al. | 211/59.3 |
| 4,821,894 | 4/1989 | Dechirot | 211/59.3 |
| 4,830,201 | 5/1989 | Breslow | 211/59.3 X |
| 4,898,282 | 2/1990 | Hawkinson et al. | 211/49.1 |
| 4,901,869 | 2/1990 | Hawkinson et al. | 211/59.3 |
| 5,111,942 | 5/1992 | Bernardin | 211/59.3 |
| 5,240,126 | 8/1993 | Foster et al. | 211/59.3 |
| 5,265,738 | 11/1993 | Yablans et al. | 211/59.3 |
| 5,390,802 | 2/1995 | Pappagallo et al. | 211/59.3 |
| 5,450,968 | 9/1995 | Bustos | 211/184 X |
| 5,634,564 | 6/1997 | Spamer et al. | 211/59.3 |

FOREIGN PATENT DOCUMENTS

| | | | |
|---|---|---|---|
| 2385365 | 12/1978 | France | 211/59.3 |

*Primary Examiner*—Robert W. Gibson, Jr.

*Attorney, Agent, or Firm*—Oppenheimer, Wolff & Donnelly, LLP

[57] ABSTRACT

A product supporting and feeding system is provided in which a plurality of tracks is mounted in spaced relationship from each other and equipped with spring-loaded sliders adapted to move the product along the tracks.

13 Claims, 3 Drawing Sheets

FIG. 4.
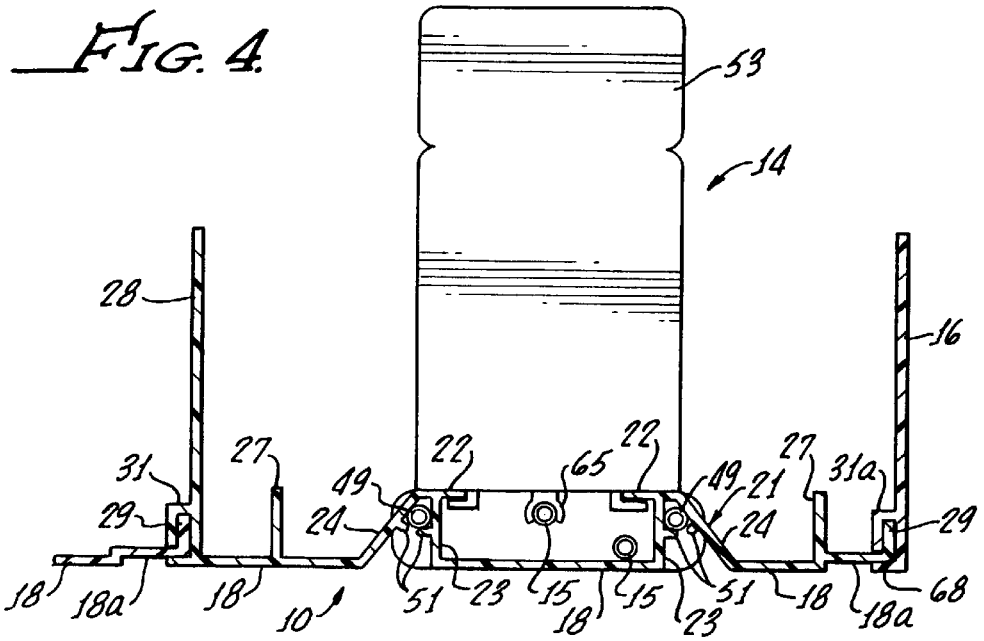
FIG. 5.
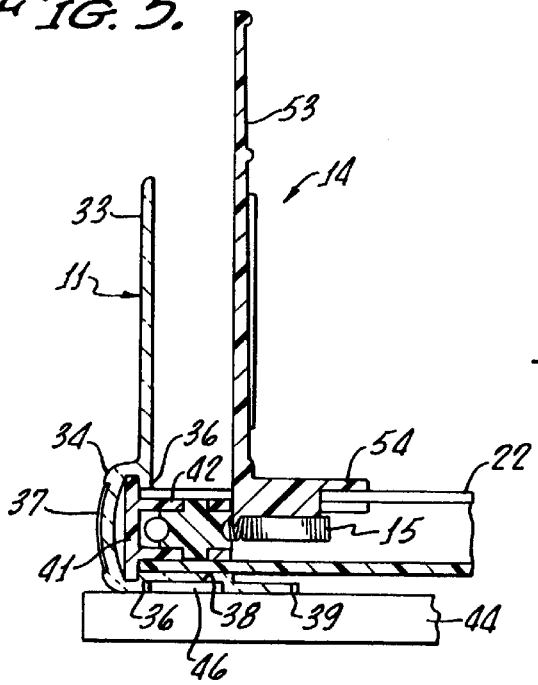
FIG. 6.
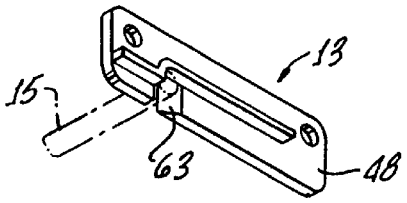
FIG. 7.
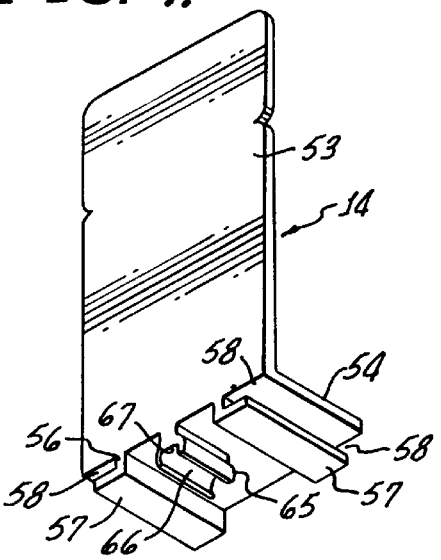
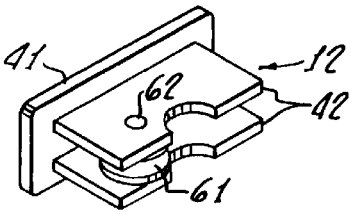
FIG. 8.

TRACK SYSTEM FOR FEEDING OF PRODUCT AT POINTS OF SALE

BACKGROUND OF THE INVENTION

Especially because shelf space is at a premium in supermarkets and numerous other points of sale or points of use, there has been a substantial amount of activity in the field of apparatus for feeding product forwardly to a point where it is highly visible and accessible to the customer or user. To be fully satisfactory, a product-feeding apparatus must be strong, inexpensive, simple to use, and adaptable to accommodate different sizes of products and their packages.

In those systems in which feeding is effected by springs, it is important that the cost of purchasing and mounting the spring mechanism be low. However, it is essential that the spring operate properly, with smoothness and with substantially linear action.

As another example, because product-feeding systems are often subject to abuse during shipment and mounting, and during use, it is important that they be strong. Furthermore, because any plastic apparatus can be broken during use as the result of especially abusive action by a customer or by store personnel, it is important that if a part does break at the forward end of the system there will be back-up action preventing product from spilling out on the floor.

To state yet another example, it is very desirable that the system be such that it can be assembled and mounted in a relatively small amount of time, by a person who does not need to be a mechanical engineer.

To state but one further example, it is important that the construction be such that for relatively small production runs the major parts of the system can be manufacturable by extrusion, but are also such that for large production runs it only requires small modification of the system to permit manufacture by injection molding.

SUMMARY OF THE INVENTION

In accordance with one aspect of the present invention, any desired number of tracks (racks) may be rapidly assembled with each other in strong interlocking relationship, and in a very short time. The tracks may be identical in width or may have different widths as desired by the particular customer. The construction is such that once the tracks are interlocked they are held against sliding relative to each other by a front stop/connector that serves also as a display means and as a mount for product designations or for decorations.

In accordance with another aspect of the invention, the several tracks may be mounted in spaced relationship from each other instead of being interlocked, being held in position on the shelf by an elongate front stop/connector that is much longer than any individual rack is wide. The front stop/connector may be secured to the underlying shelf in various ways.

In accordance with another aspect of the invention, the spring mechanism extends around only one roller and is fixedly secured at one end to the slider that pushes the product forwardly. This minimizes cost while still achieving smooth action and a generally linear force pushing against the product.

In accordance with another aspect of the invention, the slider that pushes on the product is associated with a slideway having rails that extend inwardly, this being a factor making it feasible to adapt the system for injection molding.

In accordance with another aspect of the invention, the front stop/connector is a continuous piece joining all facings in the set together, and which is easily mounted over track caps that perform functions including mounting the rollers for the springs. In the event a track cap should fail, the elongate front stop/connector would be held in place by the adjoining track caps acting through the front stop/connector.

In accordance with another aspect of the present invention, the track assemblies easily slide together in a strong interconnecting manner. Thereafter, they are further secured by means of the elongate front stop/connector that extends over the fronts of the various track caps. The front stop/connector performs various functions including preventing the track assemblies from sliding relative to each other during mounting on the shelf.

In accordance with another aspect of the invention, the track cap of each track assembly performs the functions of a stop and a roller mounting. The spring tension is such as to cooperate in maintaining each track cap in proper position.

In accordance with another aspect, there is a back plate that is readily secured to the back of each track by screws; accordingly it is not prone to popping out of the track when the slider is forced back against it while product is being loaded onto the track. The back plate incorporates a simple connector for rapid mounting of one end of the spring. The slider also incorporates a simple connector for mounting of the other end of the spring.

BRIEF DESCRIPTION OF THE DRAWINGS

FIG. 4 is a vertical sectional view taken on line 4—4 of FIG. 3;

FIG. 5 is a fragmentary longitudinal sectional view taken on line 5—5 of FIG. 2, and also showing the underlying shelf and connector means;

FIG. 6 is an isometric view of the back plate, the associated spring being shown in section;

FIG. 7 is an isometric view of the slider; and

FIG. 8 is an isometric view of the track cap.

DETAILED DESCRIPTION OF THE PREFERRED EMBODIMENT

Figure 1:
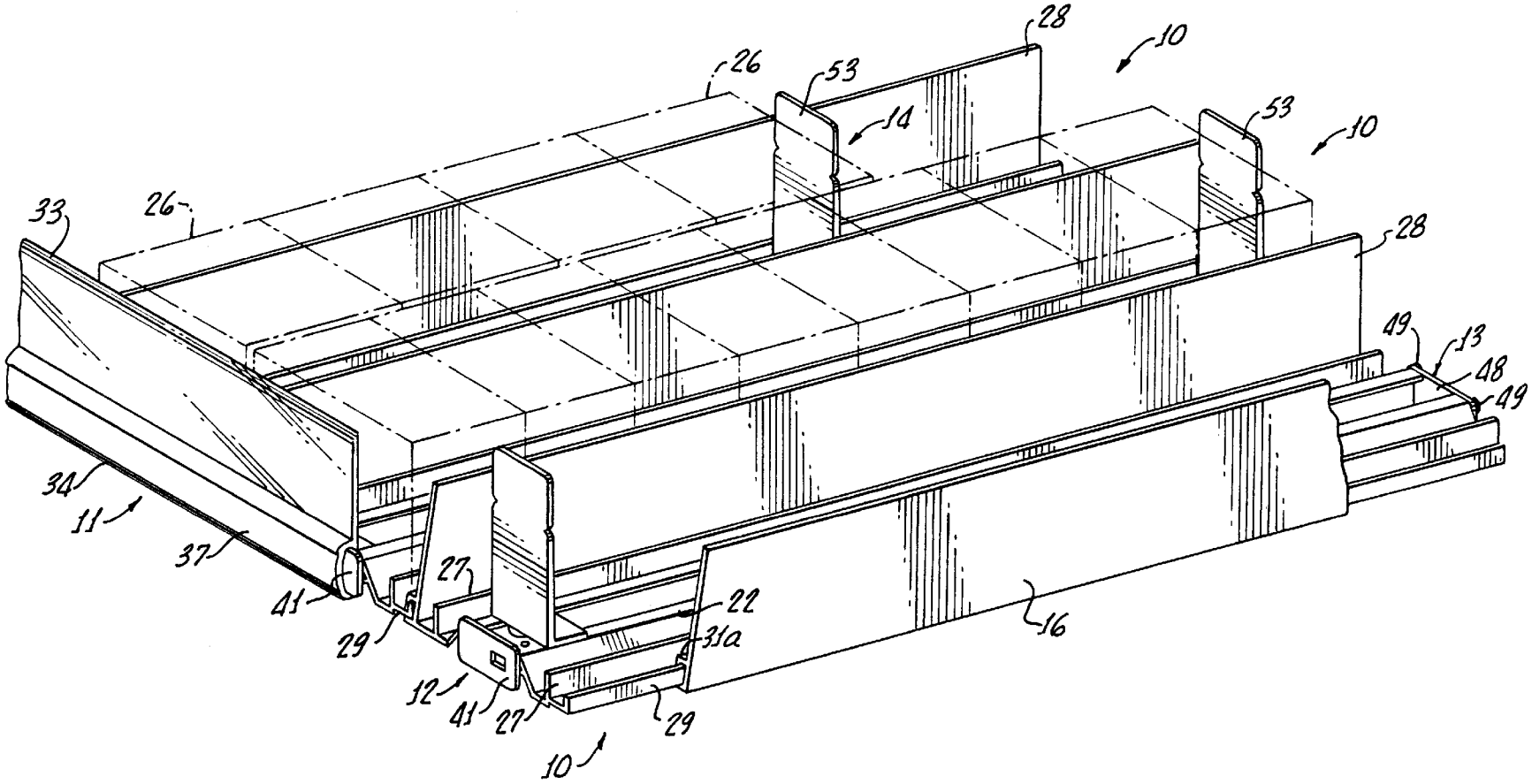
FIG. 1 is an isometric view, partly broken away, showing three track assemblies and the associated front stop/connector.

Elements of the preferred embodiment of the present track system comprise tracks 10, a front stop/connector 11, track caps 12, back plates 13, sliders 14, springs 15, and a sidewall 16 for the outermost track 10. These and other elements are discussed below.

Each track assembly illustrated in the present patent application is identical to each other track assembly so illustrated. Each component of each track assembly is identical to the corresponding component of the other track assemblies. However, the track widths may vary, as described below, and the sidewall 16 is provided on only one of the tracks. Except for the springs and screws, etc., all components are preferably formed of synthetic resin, such as ABS, styrene, or polypropylene.

The front stop/connector of the preferred embodiment of the present track system is common to all of the tracks in a track set.

Proceeding first to a detailed description of each track 10, and referring particularly to FIGS. 1–4, each track is an elongate extrusion in the illustrated embodiment. It may, however, be an injection molding for high-volume production.

As best shown in FIG. 4, the track 10 has a horizontal bottom wall 18 all portions of which are at the same elevation excepting an edge portion 18*a*, which is at a slightly higher elevation. Bottom wall 18,18*a* is integral with a slideway 21 having rail portions that are mirror images about a central vertical plane (imaginary) that extends longitudinally of the track 10. Thus, the slideway 21 has horizontal rails 22 (FIG. 4) that extend inwardly towards each other. Rails 22 are respectively supported by struts 23,24, the inner ones (23) of which are vertical and the outer ones (24) of which are inclined inwardly so as to converge with struts 23. It is to be understood that in the illustrated embodiment the struts 23,24 are walls continuous for the full lengths of the tracks 10.

The horizontal upper surfaces of rails 22 support product, for example product contained in the rows of boxes 26 that are indicated in phantom line in FIG. 1. In the illustrated embodiment, the product is supported not only on rails 22 but also on the upper edges of vertical flanges 27, reference being made to FIG. 4 in particular. Especially with tracks 10 that are less wide, the flanges 27 may be omitted.

At one longitudinal edge thereof, the left edge in FIGS. 1 and 4, track 10 has a vertical sidewall 28 that is integral with bottom wall 18. Sidewall 28 is sufficiently high to provide lateral support for the product to be held in each track, for example the product in boxes 26 (FIG. 1). At its other edge, the right edge as shown in FIGS. 1 and 4, each track has a short vertical flange 29, this being integral with the somewhat elevated bottom wall edge portion 18*a*.

As shown at the left in FIG. 4, sidewall 28 is spaced somewhat inwardly from the extreme edge of bottom wall 18. Furthermore, there is an outwardly and downwardly-extending portion 31 that is integral with the bottom region of sidewall 28 and that cooperates with the extreme left edge of bottom wall 18 in forming an interlocking groove that is sized to receive the above-mentioned short vertical flange 29 of each track. Thus, by manually sliding the right-bottom edge portion of one track 10 into the longitudinal groove formed by portion 31 and by the extreme edge of bottom wall 18, a strong interlocking joint is provided. The extreme edge of bottom wall 18 fits below the somewhat elevated edge portion 18*a* (left side of FIG. 4) so that the bottom surfaces of all bottom walls 18 nay rest flatwise on a shelf.

Proceeding next to a description of the front stop/connector 11 and referring particularly to FIGS. 1 and 5, this is an extrusion or an injection-molded part and is generally L-shaped in cross-section (just as each track 10 is L-shaped in cross-section because of the combination of bottom wall 18 and integral side wall 28). Front stop/connector 11 is secured to the forward ends of a plurality of tracks 10, perpendicularly thereof so as to run (typically) along the forward edge (the left edge in FIG. 5) of a shelf on which the tracks are mounted as stated below. Front stop/connector 11 performs several functions one of which is to prevent the product, such as boxes 26, from being pushed forwardly out of the tracks when no customer is present. Another is to display the product. Another function is to space the tracks 10 laterally from each other in those circumstances when the tracks are not interlocked. Another is to provide a surface for indicia stating what the product is and what it costs, etc., and for decorative elements.

Front wall 33 is vertical, is engaged by the boxes 26 or other product, and is transparent so as to display the outer vertical surfaces of such boxes. At its lower edge, front wall 33 merges with an outwardly-protruding track 34 that (FIG. 5) has inner flanges or lips 36 so as to perform an interlocking function. As shown at the left in FIG. 5, track 34 holds a sign or indicia or decorative portion 37 that (for example) identifies the product as above stated. The top flange 36 (FIG. 5) is a vertical lip, while the bottom one is integral with a horizontal portion 38 that extends inwardly or rearwardly beneath the front ends of the tracks. At its inner edge, portion 38 is integral with an edge portion 39 that is at a slightly lower elevation. Thus, as shown in FIG. 5, a space is provided below portion 38 and another space is provided above portion 39.

The track cap 12 for each track will next be described particularly because it (in accordance with the preferred embodiment) performs an important mounting function relative to front stop/connector 11.

Referring particularly to FIG. 8, track cap 12 comprises a vertical rectangular front plate 41 from which protrude rearwardly upper and lower parallel mounting elements 42. Stated otherwise, mounting elements 42 are horizontal plates that are spaced vertically from each other. The mounting elements 42 are inserted into the forward end of each track 10 in the space between inner struts 23 (FIG. 4). They are held in position by spring tension and also by adhesive (not shown).

The upper and lower edges of front plate 41 of each track are horizontal. Such horizontal edges are upwardly and downwardly protuberant, and are so spaced from each other that the front plate 41 fits snugly into the above-described track 34. Thus, as shown in FIG. 5, the upper and lower edges of plate 41 fit forwardly of the inner flanges or lips 36 and thus are held in place. The fit is caused to be snug so that the large tracks (racks) 10 will not slide along the front stop/connector 11 unless desired by the person assembling or mounting the track system.

In one mode of operation of the present track system, a plurality of tracks 10 are assembled with each other by sliding the short vertical flanges 29 (FIG. 4) into the grooves defined by portions 31 and by the extreme left (FIG. 4) edges of bottom walls 18. In such relationship, the integral side walls 28 form both sidewalls of all but one of the tracks, namely the end track or edge track, because the sidewall 28 functions as a sidewall for each two adjacent tracks 10.

In accordance with another mode of operation, which is followed when the product is somewhat wider than each bottom wall 18, the tracks 10 are not interlocked together at their longitudinal edges but instead are spaced somewhat apart (for example, one-half or three-quarters inch). Regardless of which mode of operation is employed, the front stop/connector 11 may serve as a means to connect to tracks to an underlying shelf. In accordance with the second mode, the front stop/connector 11 serves as the spacer determining the distance between adjacent but spaced-apart tracks, because the front plates 41 seat snugly in the tracks 34 so that the track caps 34 and thus the tracks 10 to which they are secured do not move unless intentionally moved by a person.

The front stop/connector 11 may be secured to an underlying shelf, for example shelf 44 indicated in FIG. 5, in various ways. To state but two examples, a double-sided strip of pressure-sensitive tape, numbered 46 in FIG. 5, is mounted in the space below horizontal portion 38 of the front stop. Alternatively, short elongate slots (not shown) are provided in inner edge portion 39 of the front stop 11 to receive screws that extend downwardly into the shelf. These means of connection may, if desired, be augmented in other ways. One such other way is to provide a strip of hook-loop fastener (Velcro) along the rear edge of shelf 44 (not shown), and to provide the mating type of hook-loop fastener material on the underside of the rear end of bottom wall 18. Thus, when the hook-loop fastener material is pressed together, both the outer and inner ends of each track are secured to the shelf.

Proceeding next to a description of back plate 13 for each track 10, this comprises (as shown in FIGS. 1 and 6) a rectangular element 48 that is held strongly in position by two horizontal screws 49. Screws 49 extend through holes in element 48 and into the upper portions of the spaces between struts (strut walls) 23,24. As shown in FIG. 4, there are formed integrally on the opposed surfaces of each pair of struts 23,24 small flanges 51. These flanges are so located that screws 49, which are sheet-metal screws, are threaded into the spaces thus defined and firmly hold rectangular back plate 13 in position.

Referring next to slider 14, this comprises a vertical pusher-plate 53 that bears against the outer end of each row of products, e.g., that in boxes 26 (FIG. 1). At its lower edge, plate 53 connected to a horizontal wall 54 (FIG. 7). Molded on the underside of wall 54 are shoes having vertical inner portions 56 that extend downwardly, and having horizontal portions 57 that extend outwardly from the bottom ends of portions 56. Stated otherwise, horizontal portions 57 are spaced below and are parallel to wall 54 so as to create grooves 58. Such grooves are sized to receive the inwardly-extending rails 22 (FIG. 4) of slideway 21. Thus, the slider 14 slides along rails 22 with the underside of wall 54 sliding thereon, and grooves 58 receive inwardly-extending rails 22 so as to prevent the slider 14 from getting out of position or turning.

There will next be described spring 15 and associated end connectors and roller. Spring 15 is a long, small-diameter helical tension spring having a very large number of closely-adjacent turns or coils. Such spring 15 may be purchased with various desired diameters and wire gauges, and may be cut to any desired length, in accordance with the parameters of the particular installation of the track system.

One end of spring 15 is secured to back plate 13, while the other end thereof is secured to the underside of slider 14. An intermediate portion of the spring 15 is passed around a roller in track cap 12, in a hairpin-bend relationship as shown at the left in FIGS. 2 and 3.

Figure 2:
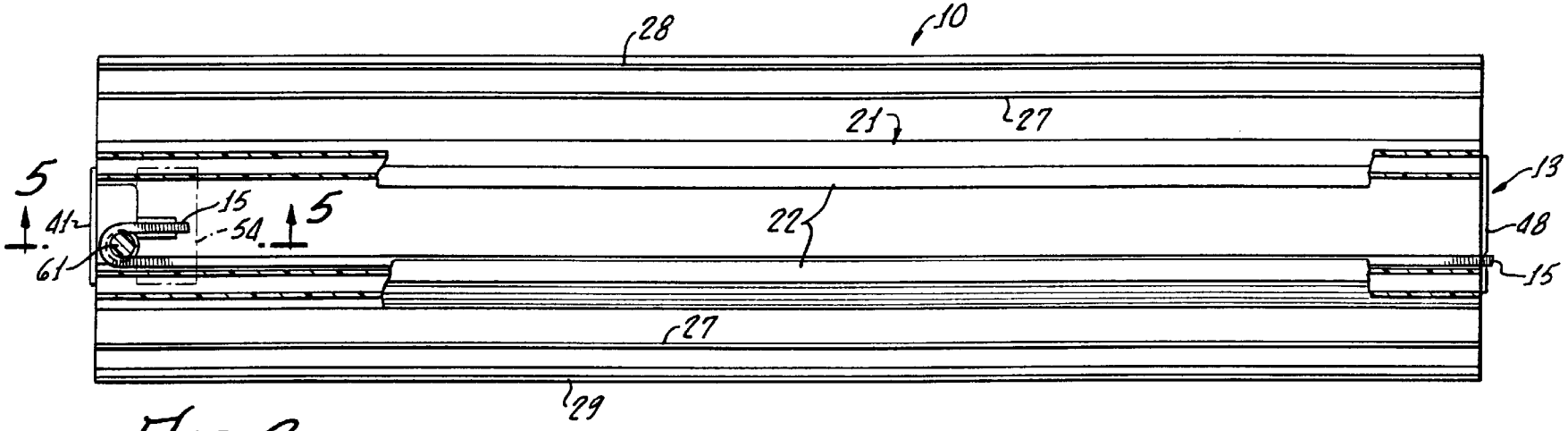
FIG. 2 is a top plan view of one of the track assemblies, portions being broken away at each end in order to show the track cap, back plate, and other elements.
Figure 3:
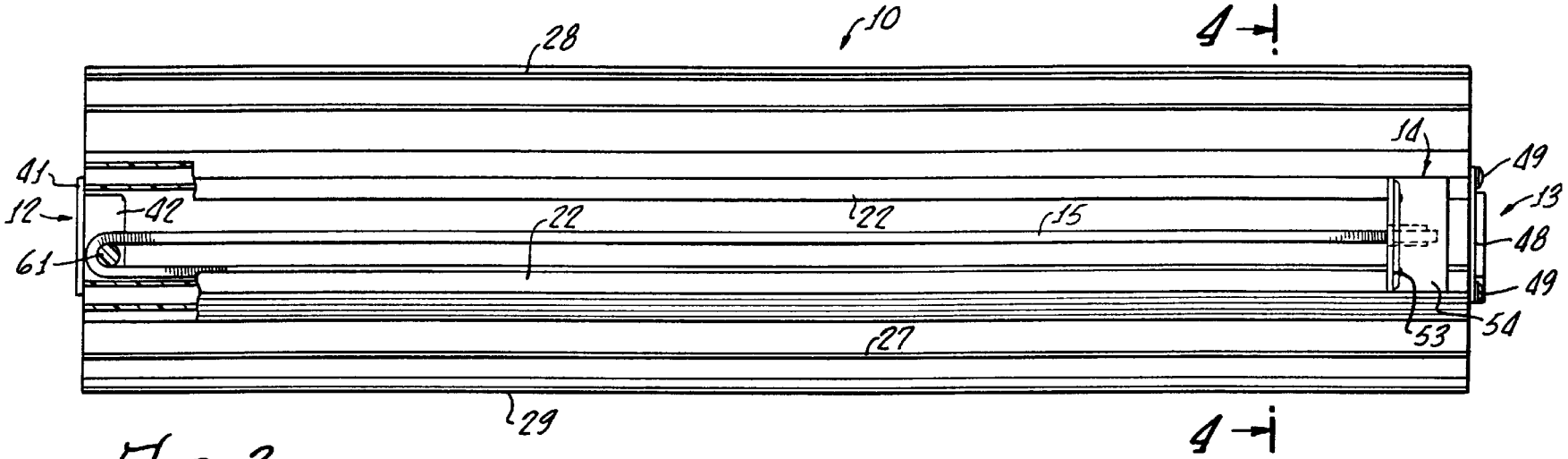
FIG. 3 is a top plan view generally corresponding to FIG. 2 but showing a different position of the slider.

The spring 15 has two runs that are parallel to each other, one run extending longitudinally of track 10 midway between rails 22. The other run extends along one side of the space between the rails, namely below one of the rails 22 so as to be substantially concealed thereby (FIGS. 2 and 3).

Referring to FIG. 8, the roller around which spring 15 extends is numbered 61, being mounted on a vertical pin 62 for rotation about a vertical axis. The roller is freely rotatable in a horizontal plane in the space between the upper and lower mounting elements 42 of track cap 12.

The connection of one end of spring 15 to the rectangular element 48 of back plate 13 is shown in FIG. 6. As there illustrated, there is a vertical slot 63 in the bottom of element 48 that is sized to receive the spring end. Adjacent such slot 63, one edge portion of element 48 is made relatively sharp and is inserted into the spring 15 between adjacent coils thereof, so as to hold the spring end firmly in position in element 48.

Referring to FIG. 7, the means for securing a spring end to the underside of wall 54 is best illustrated. This comprises wall means 65 to form a channel 66 that is sized to snugly receive the spring 15. The forward end of channel 66 is defined in part by a sharp edge portion 67 (FIGS. 5 and 7) that fits between adjacent coils of spring 15 and it thus cooperates with the walls of channel 66 locking the spring end firmly in position.

The spring 15 and associated connecting elements and roller is very effective yet very economical. The spring tension does not change greatly regardless of whether the slider 14 is at the front position near front stop/connector 11 or the rear position near back plate 13.

Proceeding next to a description of the sidewall 16 for the outermost track 10, shown at the right in FIG. 1 and 4, this is a single vertical element having formed integrally therewith an outwardly and downwardly extending portion 31*a* that corresponds to the above-described portion 31 (FIG. 4). Furthermore, at its extreme lower edge the wall 16 has an inwardly extending portion 68 that is spaced below the bottom edge of portion 31*a*. Thus, like portion 31 and the associated left edge of bottom wall 18, portion 31*a* and the associated inwardly-extending portion 68 receives the edge portion of bottom wall 18*a* of the track and also receives the upwardly extending short vertical flange 29. Thus, these elements are slidable into the described groove/passage so as to provide strong interlocking and connecting relationships.

Wall 16 serves as a sidewall for the outermost track, there being no integral outer wall for such outermost track. Furthermore, in those situations where any track 10 is used by itself, not interrelated with any other track, wall 16 forms the second sidewall of the single track.

Further Description of Operation and Advantages of the Track System

Typically, the tracks 10 are assembled with track caps 12, back plates 13, sliders 14, springs 15, and sidewalls 16 at the factory. Typically, they are also associated with front stop/connector 11 at the factory and then shipped to a point of use. Some customers, however, do assemble the tracks with each other and/or with the front stop/connector at the point of sale or use.

In any event, the front stop/connector 11 may be connected to a shelf 44 in a supermarket or other point of use, as described in detail above relative to FIG. 5. The sidewall 16 for the outermost track in a track set (right side of FIG. 4) is mounted at the factory or at the store.

Although the front stop/connector 11 may be connected to the underlying shelf, this does not usually happen. The tracks are (typically) cut to the same length as the depth of such underlying shelf, so that the inner ends of the tracks rest against the upwardly-extending back wall of the shelf, and the tracks are thus prevented from being pushed inwardly.

It is then merely necessary for the operator to push the product (such as is contained in boxes 26, FIG. 1) into the channels defined between walls 28 (and in the case of the end unit, wall 16). As each track is thus loaded, the slider 14 moves back so that the spring 15 becomes more and more tensioned. However, because the spring is so long and has so many coils there is not a great increase in spring tension due to the loading action. The boxes 26 rest on rails 22 and flanges 27 and slide forwardly as individual units of product are removed by the customers, who simply lift the product over front stop/connector 33 and carry it away.

The front stop/connector 11 performs the additional function of maintaining locked-together (assembled) tracks 10 in the same plane (as distinguished from bending somewhat) during handling as the track sets are mounted on shelf 44.

The track caps 12 serve additionally (as described above) as roller or pulley mounts. The rectangular front plates 41 (FIGS. 1 and 8) absorb much of the load, it being pointed out that the rollers 61 are preferably not mounted on the tracks 10 directly but instead on the track caps 12 (FIG. 8).

In the event that a track cap 12 should become dislodged, e.g. unglued, it is nevertheless held in position by the front stop/connector 11 which in turn is secured in position by the track caps of other track assemblies.

Although all of the tracks shown in the present drawings have the same width, it is pointed out that different widths (and lengths) of tracks can be used together and locked and mounted in place.

The tension of the product pushing against the front stop/connector 11, and against the track cap 12, is nullified by the tension of the spring pulling back against the track cap, so that the load on the track cap is small.

The back plate 13 serves two main purposes: to prevent the slider 14 from coming off the back of the track, and to fasten one end of the spring.

In order to increase the amount of product that can be loaded in a track, it is possible to mount the slider 14 in a position the reverse of that illustrated.

The very long spring 15 provides linear tensioning, and smooth action, to create consistent feeding action along the entire length of the track.

The outer-lower portion of the present front stop/connector 11 will accommodate placement of colored tape (or the above-indicated indicia) inside the channel, to complement the package design of the product on the track.

The fact that the present track 10 is in the preferred embodiment molded in once piece makes it rigid and durable, especially when combined with the front stop/connector 11.

The foregoing detailed description is to be clearly understood as given by way of illustration and example only, the spirit and scope of this invention being limited solely by the appended claims.

What is claimed is:

1. A product supporting and feeding system, which comprises:

(a) a shelf, (b) a plurality of elongate tracks disposed on said shelf in parallel relationship to each other, each of said tracks being adapted to hold a row of product to be fed forwardly, said tracks being closely adjacent each other, said tracks having outer ends, (c) means to interlock longitudinal edges of at least some of said tracks with longitudinal edges of adjacent tracks, and (d) a front stop and connector element mounted on said outer ends of said tracks perpendicular to said tracks, said front stop and connector element preventing product from going out said outer ends of said tracks unless intentionally removed by a person, said front stop and connector element aiding in connection and positioning of said tracks relative to each other.

2. The invention as claimed in claim 1, in which said front stop and connector element is, at least in large part, transparent so as to permit persons to look therethrough at said product.

3. The invention as claimed in claim 1, in which means are provided to secure said front stop and connector to said shelf.

4. A track system for feeding a product at a point of sale or use, which comprises;

(a) at least one elongate track adapted to hold a row of product to be fed forwardly, said track being a synthetic resin extrusion, (b) a slideway provided in said track longitudinally thereof.

said slideway comprising rails supported by strut walls that incline relative to each other, (c) a slider mounted on said slideway and adapted to push against the rearmost product in said row, (d) an elongate helical tension spring having one end connected at the rear end portion of said track, having the other end connected to said slider, and having an intermediate portion mounted around a roller at the front end of said track, said spring having only two runs, one of which extends from said rear end portion of said track to said roller, and the other of which extends from said roller to said slider, the connection between said spring and said rear end portion of said track being to a back plate mounted at the rear end of said track, (e) screws extended through said back plate into spaces between said strut walls, and (f) flanges provided in said spaces between said strut walls to cooperate with said strut walls in holding the shanks of said screws, thereby effecting said mounting of said back plate.

5. A track system for feeding a product at a point of sale or use, which comprises;

(a) at least one elongate track adapted to hold a row of product to be fed forwardly, (b) a slideway provided in said track longitudinally thereof, (c) a slider mounted on said slideway and adapted to push against the rearmost product in said row, (d) an elongate helical tension spring having one end connected at the rear end portion of said track, having the other end connected to said slider, and having an intermediate portion mounted around a roller at the front end of said track, said spring having only two runs, one of which extends from said rear end portion of said track to said roller, and the other of which extends from said roller to said slider, said roller being mounted in a track cap that is provided at the front end of said track.

6. The invention as claimed in claim 5, in which said track cap includes a plate that fits over a front end portion of said track, in which a plurality of said tracks are provided in parallel relationship to each other with their side edges in proximity to each other, in which a front stop and connector is provided at the front ends of said tracks, in which said front stop and connector has a groove adapted to receive edge portions of said plates, and in which said edge portions of said plates are disposed in said groove for connection of said front stop and connector to said tracks.

7. A product supporting and feeding system, which comprises:

(a) a plurality of elongate synthetic resin tracks oriented in parallel relationship to each other, each of said tracks being adapted to hold a row of product to be fed forwardly, said tracks being adjacent each other, said tracks having outer ends, said tracks having bottom walls, said tracks having upwardly-extending side walls, (b) means to interlock longitudinal edges of at least some of said tracks with longitudinal edges of adjacent tracks, said means to interlock said edges including grooves that extend longitudinally of said tracks, said means to interlock said edges further including elements that enter said grooves in response to movement of adjacent tracks longitudinally relative to each other, and that after entering said grooves form interlocking joints between adjacent tracks, said interlocking joints extending for large distances longitudinally of said tracks, and (d) front stop means mounted at said outer ends of said tracks to prevent product from going out said outer ends of said tracks unless intentionally removed by a person.

8. The invention as claimed in claim 7, in which said tracks are extrusions of synthetic resin, and in which said grooves and said elements that enter said grooves are formed by extrusion.

9. The invention as claimed in claim 7, in which each of said tracks has said bottom wall that is integral with one of said upwardly extending sidewalls, whereby said one integral sidewall acts as a sidewall for two of said tracks that are adjacent each other, and in which another of said upwardly-extending sidewalls of said tracks is not integral with any track but instead interlocks at the bottom of said other sidewall with a longitudinal groove in a track, said other sidewall having an element at its bottom region in a direction longitudinal to said tracks and that is shaped to hold said another sidewall effectively in upwardly extending position.

10. The invention as claimed in claim 7, in which said interlocked tracks have bottom surface regions near said interlocking points that are shaped to fit closely on the upper surface of a shelf.

11. A track system for feeding a product at a point of sale or use, which comprises:

(a) elongate synthetic resin tracks each adapted to hold a row of product to be fed forwardly, (b) a slideway provided in said track longitudinally thereof, (c) a slider mounted on said slideway and adapted to push against the rearmost product in said row, (d) spring means provided between said slider and the front portion of said track to feed said product toward said front portion of said track, (e) a track cap mounted at said front portion of said track, and (f) a front stop mounted at the front end of said track, in which each said track cap has a mounting portion connected to said front portion of said track, and has a front plate connected to said mounting portion and held in place thereby, and in which each said front plate is associated with said front stop to mount said front stop.

12. The invention as claimed in claim 11, in which said front stop is an elongate element having a groove therein to receive said front plates of a plurality of said track caps.

13. The invention as claimed in claim 12, in which said tracks are adjacent each other and are connected together by interlocking joints as well as by said front stop.

* * * * *